US011773658B2

(12) United States Patent
Younger et al.

(10) Patent No.: US 11,773,658 B2
(45) Date of Patent: Oct. 3, 2023

(54) QUICK CONNECTION INTERFACE FOR ELECTRICAL SUBMERSIBLE PUMP COMPONENTS

(71) Applicant: SAUDI ARABIAN OIL COMPANY, Dhahran (SA)

(72) Inventors: Rae Andrew Younger, Ellon (SC); Richard Mark Pye, Aberdeen (GB); Graham Richard Hitchcock, Aberdeen (SC); Rafael Adolfo Lastra, Dhahran (SA); Faris Hasan Tulbah, Al Khobar (SA)

(73) Assignee: SAUDI ARABIAN OIL COMPANY, Dhabran (SA)

( * ) Notice: Subject to any disclaimer, the term of this patent is extended or adjusted under 35 U.S.C. 154(b) by 144 days.

(21) Appl. No.: 17/362,434

(22) Filed: Jun. 29, 2021

(65) Prior Publication Data

US 2022/0412172 A1 Dec. 29, 2022

(51) Int. Cl.
*E21B 17/046* (2006.01)
*E21B 31/00* (2006.01)

(52) U.S. Cl.
CPC ..... *E21B 17/046* (2013.01); *E21B 31/00* (2013.01)

(58) Field of Classification Search
CPC .... E21B 17/046; E21B 17/0465; E21B 17/06; E21B 31/00
See application file for complete search history.

(56) References Cited

U.S. PATENT DOCUMENTS 3,920,270 A * 11/1975 Babb, Jr. ..... F16L 21/08 285/104
4,347,012 A * 8/1982 Glidden ..... B63B 21/50 114/294

(Continued)

FOREIGN PATENT DOCUMENTS

CN 204386900 U 6/2015
WO 2017115094 A1 7/2017

(Continued)

OTHER PUBLICATIONS

International Search Report and Written Opinion issued in corresponding International Patent Application No. PCT/US2022/035522, dated Sep. 26, 2022 (11 pages).

*Primary Examiner* — David Carroll
(74) *Attorney, Agent, or Firm* — Osha Bergman Watanabe & Burton LLP

(57) ABSTRACT

A system includes an upper connection having a ring shape with an external surface, where upper splines are formed on the external surface and the upper connection is fixed to the upper section. The system also includes a lower connection having a ring shape with an internal surface, where lower splines are formed on the internal surface and the lower splines are configured to mate with the upper splines of the upper connection. Further, the system includes a fishing sub having a first lateral end and a second lateral end, where the first lateral end is fixed to the lower connection by shear pins configured to shear when a pre-determined tension is applied to the system, and the second lateral end is fixed to the lower section. The upper connection is inserted into the lower connection to form an engagement between the upper section and the lower section.

18 Claims, 6 Drawing Sheets

(56) References Cited

U.S. PATENT DOCUMENTS

| | | | | |
|---|---|---|---|---|
| 4,830,408 | A * | 5/1989 | Reimert | E21B 17/08 285/308 |
| 5,348,086 | A | 9/1994 | Trout | |
| 5,361,844 | A * | 11/1994 | Taylor | E21B 31/18 166/301 |
| 6,561,775 | B1 | 5/2003 | Wefers | |
| 8,910,721 | B1 * | 12/2014 | Harris | E21B 43/10 166/242.6 |
| 2014/0102721 | A1 | 4/2014 | Bespalov et al. | |
| 2015/0027728 | A1 | 1/2015 | Tetzlaff et al. | |
| 2015/0130185 | A1 | 5/2015 | Knapp | |
| 2015/0184675 | A1 | 7/2015 | Wilson et al. | |
| 2015/0191981 | A1 | 7/2015 | Morgan et al. | |
| 2021/0140247 | A1 * | 5/2021 | Bishop | E21B 17/028 |

FOREIGN PATENT DOCUMENTS

| | | | |
|---|---|---|---|
| WO | 2017/197043 | A2 | 11/2017 |
| WO | 2018039086 | A1 | 3/2018 |
| WO | 2020061133 | A1 | 3/2020 |

* cited by examiner

QUICK CONNECTION INTERFACE FOR ELECTRICAL SUBMERSIBLE PUMP COMPONENTS

BACKGROUND

Hydrocarbon fluids are often found in hydrocarbon reservoirs located in porous rock formations far below the earth's surface. Wells may be drilled to extract the hydrocarbon fluids from the hydrocarbon reservoirs. Most wells have a variation of downhole equipment, such as Electrical Submersible Pump (ESP) systems, installed to help with the production of hydrocarbons. When work must be done on the downhole equipment, the well either needs to be killed, by pumping a heavily weighted fluid downhole, or a lubricator must be used in order to control the pressure difference between the well and the atmosphere.

Killing a well may lead to well damage, costly repairs, and impaired future hydrocarbon extraction. However, using a lubricator limits the length of equipment that may be used in the well, as the entirety of the downhole equipment must fit within the sealing valves on either side of the lubricator. Lubricator operations use wireline or slickline and therefore do not have the ability to rotate the downhole equipment. As such, a system which allows downhole equipment to be connected and disconnected within the well, beneath the lubricator, is beneficial because longer pieces of downhole equipment may be used, or installed, without having to kill the well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in one or more embodiments, a system and methods for connecting and disconnecting an upper section to a lower section. The system includes an upper connection having a ring shape with an external surface, where upper splines are formed on the external surface and the upper connection is fixed to the upper section. The system also includes a lower connection having a ring shape with an internal surface, where lower splines are formed on the internal surface and the lower splines are configured to mate with the upper splines of the upper connection. Further, the system includes a fishing sub having a first lateral end and a second lateral end, where the first lateral end is fixed to the lower connection by shear pins configured to shear when a pre-determined tension is applied to the system, and the second lateral end is fixed to the lower section. The upper connection is inserted into the lower connection to form an engagement between the upper section and the lower section.

In other embodiments, the method for connecting the upper section to the lower section includes connecting a first lateral end of a fishing sub to a lower end of a lower connection, where the lower connection has an internal surface fixed with lower splines and a snap ring. Connecting a second lateral end of the fishing sub to a lower section and connecting a head of an upper connection to an upper section, where the upper connection has an external surface fixed with upper splines and a snap ring receptacle. The method further includes lowering the lower section, the fishing sub, and the lower connection into a lubricator where the lower section enters the lubricator first followed by the fishing sub and then the lower connection, hanging the lower section, the fishing sub, and the lower connection beneath the lubricator, lowering the upper section and the upper connection into the lubricator where the upper connection enters the lubricator first followed by the upper section, and inserting a conical nose of the upper connection into an upper end of the lower connection where the snap ring expands and falls into the snap ring receptacle, connecting the upper section to the lower section.

In further embodiments, the method for disconnecting the upper section from the lower section includes applying tension to an upper section wherein the upper section is connected to an upper connection and the upper connection is connected to a lower connection, wherein the upper connection has upper splines and a snap ring receptacle, and the lower connection has lower splines and a snap ring, shearing shear pins connecting the lower connection to a fishing sub wherein the fishing sub has a fishing tool interface and fishing splines, pulling the upper section, upper connection, and lower connection through a lubricator, lowering a fishing tool, with a profile, into the lubricator, inserting the fishing tool into the fishing sub to engage the profile and the fishing tool interface, and pulling the fishing tool, fishing sub, and the lower section, connected to the fishing sub, through a lubricator.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
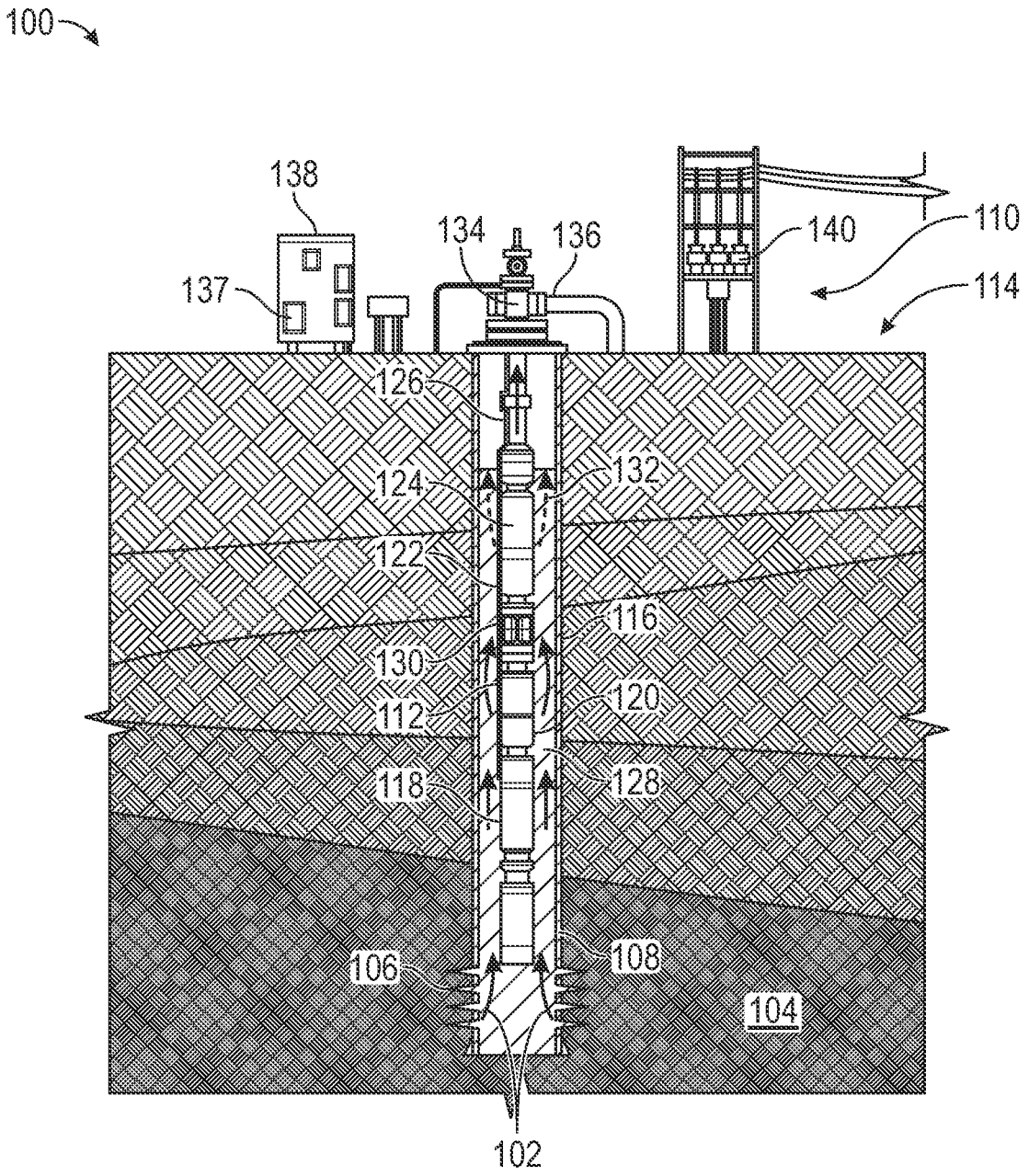
FIG. 1 shows an exemplary well with an Electrical Submersible Pump (ESP) completion design in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Electrical Submersible Pumps (ESPs) are a form of artificial lift for production wells. However, ESPs often do not last the life of the well and they may need to be repaired or replaced. Conventional methods of repairing or replacing the ESP consist of taking the well out of service and injecting the well with a heavily weighted fluid to "kill" the well. However, injecting fluids down a completed well may damage the well, thus, other methods of repairing or replacing ESPs using a lubricator and a Blow-Out Preventer (BOP) stack are preferred.

Lubricators are made of high-pressure pipe and an assortment of valves. Lubricators control the difference in pressure between the pressurized well and the atmosphere. However, lubricators operate by placing the entirety of the ESP between two valves and equalizing pressure either between the lubricator and the well or between the lubricator and the atmosphere. Therefore, a lubricator may only be used when the complete ESP string can fit into the lubricator. Further, a lubricator is used along with a wireline or slickline unit, both of which do not have the ability to rotate the downhole equipment.

Commonly, a complete ESP is much longer than the longest lubricator, and using a lubricator may not be applicable to repair or replace the ESP. If the ESP could be broken up into a plurality of sections, the lengths of which do fit in the lubricator, and reassembled beneath the lubricator (without rotation), then a lubricator may be used on any well no matter the length of the required ESP. As such, embodiments disclosed herein present systems and methods that allow downhole equipment, such as ESPs, to be assembled and disassembled beneath a lubricator without rotation. More specifically, embodiments disclosed herein are directed to an apparatus that allows quick, efficient, and reliable connection and disconnection of ESP components without the need of bolts or tools. In one application, the mechanism disclosed herein allows the deployment of sections of an ESP through a wellhead lubricator before being assembled together into a larger ESP strings below the lubricator; as a result, longer ESP assemblies can be deployed into a live well than would otherwise be possible.

FIG. 1 shows an exemplary ESP system (100). The ESP system (100) is used to help produce produced fluids (102) from a formation (104). Perforations (106) in the well's (116) casing (108) provide a conduit for the produced fluids (102) to enter the well (116) from the formation (104). The ESP system (100) includes surface equipment (110) and an ESP string (112). The ESP string (112) is deployed in a well (116) and the surface equipment (110) is located on the surface (114). The surface (114) is any location outside of the well (116), such as the Earth's surface.

The ESP string (112) may include a motor (118), motor protectors (120), a gas separator (122), a multi-stage centrifugal pump (124) (herein called a "pump" (124)), and a power cable (126). The ESP string (112) may also include various pipe segments of different lengths to connect the components of the ESP string (112). The motor (118) is a downhole submersible motor (118) that provides power to the pump (124). The motor (118) may be a two-pole, three-phase, squirrel-cage induction electric motor (118). The motor's (118) operating voltages, currents, and horsepower ratings may change depending on the requirements of the operation.

The size of the motor (118) is dictated by the amount of power that the pump (124) requires to lift an estimated volume of produced fluids (102) from the bottom of the well (116) to the surface (114). The motor (118) is cooled by the produced fluids (102) passing over the motor (118) housing. The motor (118) is powered by the power cable (126). The power cable (126) may also provide power to downhole pressure sensors or onboard electronics that may be used for communication. The power cable (126) is an electrically conductive cable that is capable of transferring information. The power cable (126) transfers energy from the surface equipment (110) to the motor (118). The power cable (126) may be a three-phase electric cable that is specially designed for downhole environments. The power cable (126) may be clamped to the ESP string (112) in order to limit power cable (126) movement in the well (116). In further embodiments, the ESP string (112) may have a hydraulic line that is a conduit for hydraulic fluid. The hydraulic line may act as a sensor to measure downhole parameters such as discharge pressure from the outlet of the pump (124).

Motor protectors (120) are located above (i.e., closer to the surface (114)) the motor (118) in the ESP string (112). The motor protectors (120) are a seal section that houses a thrust bearing. The thrust bearing accommodates axial thrust from the pump (124) such that the motor (118) is protected from axial thrust. The seals isolate the motor (118) from produced fluids (102). The seals further equalize the pressure in the annulus (128) with the pressure in the motor (118). The annulus (128) is the space in the well (116) between the casing (108) and the ESP string (112). The pump intake (130) is the section of the ESP string (112) where the produced fluids (102) enter the ESP string (112) from the annulus (128).

The pump intake (130) is located above the motor protectors (120) and below the pump (124). The depth of the pump intake (130) is designed based off of the formation (104) pressure, estimated height of produced fluids (102) in the annulus (128), and optimization of pump (124) performance. If the produced fluids (102) have associated gas, then a gas separator (122) may be installed in the ESP string (112) above the pump intake (130) but below the pump (124). The gas separator (122) removes the gas from the produced fluids (102) and injects the gas (depicted as separated gas (132) in FIG. 1) into the annulus (128). If the volume of gas exceeds a designated limit, a gas handling device may be installed below the gas separator (122) and above the pump intake (130).

The pump (124) is located above the gas separator (122) and lifts the produced fluids (102) to the surface (114). The pump (124) has a plurality of stages that are stacked upon one another. Each stage contains a rotating impeller and stationary diffuser. As the produced fluids (102) enter each stage, the produced fluids (102) pass through the rotating impeller to be centrifuged radially outward gaining energy in the form of velocity. The produced fluids (102) enter the diffuser, and the velocity is converted into pressure. As the produced fluids (102) pass through each stage, the pressure continually increases until the produced fluids (102) obtain the designated discharge pressure and has sufficient energy to flow to the surface (114).

In other embodiments, sensors may be installed in various locations along the ESP string (112) to gather downhole data such as pump intake volumes, discharge pressures, and temperatures. The number of stages is determined prior to installation based of the estimated required discharge pressure. Over time, the formation (104) pressure may decrease and the height of the produced fluids (102) in the annulus (128) may decrease. In these cases, the ESP string (112) may be removed and resized. Once the produced fluids (102) reach the surface (114), the produced fluids (102) flow through the wellhead (134) into production equipment (136). The production equipment (136) may be any equipment that can gather or transport the produced fluids (102) such as a pipeline or a tank.

The remainder of the ESP system (100) includes various surface equipment (110) such as electric drives (137) and pump control equipment (138) as well as an electric power supply (140). The electric power supply (140) provides energy to the motor (118) through the power cable (126). The electric power supply (140) may be a commercial power distribution system or a portable power source such as a generator. The pump control equipment (138) is made up of an assortment of intelligent unit-programmable controllers and drives which maintain the proper flow of electricity to the motor (118) such as fixed-frequency switchboards, soft-start controllers, and variable speed controllers. The electric drives (137) may be variable speed drives which read the downhole data, recorded by the sensors, and may scale back or ramp up the motor (118) speed to optimize the pump (124) efficiency and production rate. The electric drives (137) allow the pump (124) to operate continuously and intermittently or be shut-off in the event of an operational problem.

Figure 2:
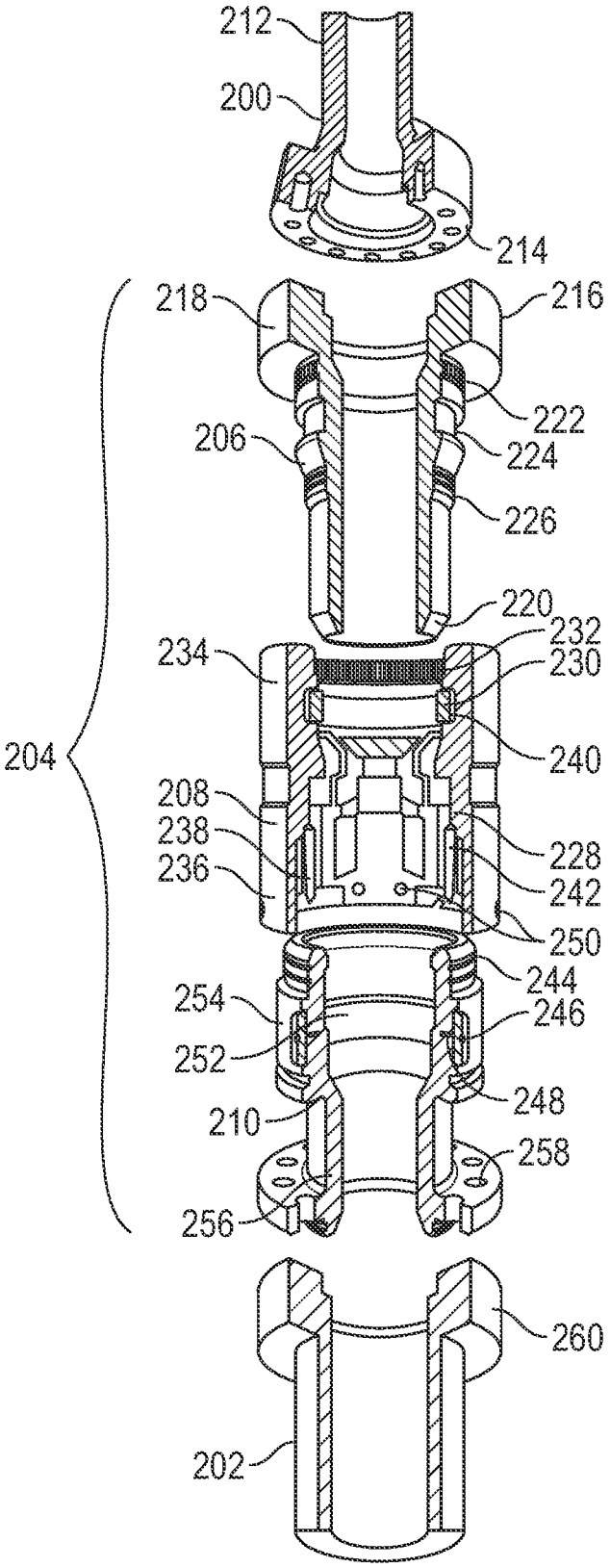
FIG. 2 shows a system in accordance with one or more embodiments.

FIG. 2 depicts a system for connecting an upper section (200) to a lower section (202) using a quick connection assembly (204) in one or more embodiments. The quick connection assembly (204) is made of an upper connection (206), a lower connection (208), and a fishing sub (210). The quick connection assembly (204) allows for the upper section (200) to be connected to the lower section (202) in cases where rotation of the equipment is unavailable such as deployment using wireline or slickline. The quick connection assembly (204) further allows for the two sections (200, 202) to be connected downhole in a well (116) where the use of bolts or other tools are unavailable. The quick connection assembly (204) forms a structural interface between the upper section (200) and the lower section (202). The quick connection assembly (204) transfers all forces between the two sections (200, 202) including torque, tension, bending, and compression. The quick connection assembly (204) also resists internal and external pressures and provides a pressure retaining seal.

The upper section (200) may be any portion of downhole equipment such as a portion of a completion string, a portion of a production string (such as an ESP string), a portion of a drill string, a portion of a workover string, etc. In FIG. 2, the upper section (200) is depicted as production tubing (212) with an upper section bolted flange (214). The production tubing (212) may have production equipment fixed to it such as pumps (124), gas separators (122), valves, etc. The upper section bolted flange (214) serves as a means of connecting the upper section (200) to another piece of equipment. The upper section bolted flange (214) is a bolted flange connection made of a combination of flanges, bolts, seals, and/or gaskets. The upper section bolted flange (214) is configured to mate with a corresponding bolted flange connection such as the upper connection bolted flange (216). The upper section bolted flange (214) and the upper connection bolted flange (216) may be screwed together using bolts. In other embodiments, the upper section bolted flange (214) and the upper connection bolted flange (216) may be welded together or any similar mechanical joining method.

The upper connection (206) of the quick connection assembly (204) may have a ring shape with a central orifice that may allow for fluid to flow therein. The upper connection (206) has two lateral ends. The lateral end which mates with the upper section (200) is the head (218), and the lateral end which mates with the lower connection (208) of the quick connection assembly (204) is the conical nose (220). The head (218) may have an upper connection bolted flange (216) which is a bolted flange connection made of a combination of flanges, bolts, seals, and/or gaskets. The upper connection bolted flange (216) is configured to mate with a corresponding bolted flange connection such as the upper section bolted flange (214). In other embodiments, the upper connection (206) may be connected to the upper section (200) by any means available in the art such as being threaded, welded, bonded, swaged, or friction welded. Although the upper section (200) and the upper connection (206) are depicted as two separate entities, those skilled in the art will appreciate that the upper connection (206) may be manufactured as a component of the upper section (200) without departing from the scope of the disclosure herein.

The upper connection (206) further has an external surface designed with upper splines (222), a snap ring receptacle (224), and at least one upper seal (226). The upper seals (226) are depicted as dual seals in FIG. 2; however, the upper seals (226) may be a single seal or a plurality of additional seals. In one or more embodiments, the upper seals (226) are depicted as O-ring seals. In other embodiments, the upper seals (226) may be quad-ring seals, spring-energized seals, or any sealing device known in the art. Further, the upper seals (226) may not be identical, and the upper seals (226) may be made of soft seals, hard seals, wiper seals, or any combination thereof. The upper seals (226) are located adjacent to the conical nose (220) to minimize the potential for the upper seals (226) to make unwanted contact with protrusions prior to the upper seals (226) entering the upper seal bore (228) located in the lower connection (208). The outer diameter of the upper seals (226) is smaller than the inner diameter of the snap ring (230) such that the upper seals (226) do not contact the snap ring (230) when the upper connection (206) is inserted into the lower connection (208).

The snap ring receptacle (224) is configured to receive a snap ring (230) and is depicted as a single groove in the external surface of the upper connection (206). However, the snap ring receptacle (224) may have a plurality of grooves in the external surface. Multiple grooves (i.e., multiple snap ring receptacles (224)) increase the shear capacity of the snap ring (230) while reducing bearing stress in the mating faces by sharing the load across multiple faces. In the case of multiple grooves or multiple snap ring receptacles (224) the lower connection (208) may have multiple snap rings (230), and the snap rings (230) and snap ring receptacles (224) may have different diameters such that the snap rings (230) pass through the snap ring receptacles (224) until the upper connection (206) is fully inserted into the lower connection (208) and the corresponding snap rings (230) and snap ring receptacles (224) are adjacent to each other and the components may be fully engaged.

The protruding aspects of the snap ring receptacle (224) may be manufactured with a slight taper to the vertical sides, such that when the snap ring (230) falls into the snap ring receptacle (224), the tapered profile acts to tighten the connection between the upper connection (206) and the lower connection (208). This design allows for wider tolerances between the mating parts between the upper connection (206) and the lower connection (208). This design further ensures the connection engages and tightens even if debris enters the system. In other embodiments the protruding aspects of the snap ring receptacle (224) may be straight, or only one of the protruding aspects of the snap ring receptacle (224) may be manufactured with a slight taper.

The upper splines (222) are adjacent to the upper connection bolted flange (216). They are depicted as being located directly beneath the upper connection bolted flange (216) upset such that the upper splines (222) are protected from damage during deployment. The upper splines (222) are a plurality of manufactured grooves in the external surface of the upper connection (206). The upper splines (222) are designed to mate with the lower splines (232) of the lower connection (208). The upper splines (222) may be used to orient the upper connection (206) and upper section (200) as the engagement between the upper connection (206) and lower connection (208) is made. Further, the upper splines (222) are designed to react to torque after the upper splines (222) mate with the lower splines (232). This prevents the upper connection (206) from rotating within the lower connection (208) when a torque is applied.

The upper splines (222) are depicted as straight, vertical grooves, however, the upper splines (222) may be designed in an index path or similar profile. The upper splines (222) and the lower splines (232) may be designed to allow the upper connection (206) to rotate to a specific orientation within the lower connection (208), once the specific orientation is reached, the mating between the upper splines (222) and the lower splines (232) prevent applied torque from further rotating the upper connection (206) within the lower connection (208). The upper splines (222) may be further designed with an undercut adjacent to the upper connection bolted flange (216) to simplify the machining process of the upper connection (206). The upper connection (206) is depicted as a single homogeneous item to maximize strength; however, the upper connection (206) may be manufactured from a number of smaller components which may be connected together by any means known in the art such as being threaded, welded, bonded, swaged, or friction welded.

The lower connection (208) may have a ring shape with a central orifice that is designed to allow a portion of the upper connection (206) to pass therein. The lower connection (208) and has two lateral ends. The lateral end that mates with the upper connection (206) is the upper end (234) of the lower connection (208) and the lateral end that mates with the fishing sub (210) is the lower end (236) of the lower connection (208). The lower connection (208) has an internal surface with lower splines (232), a snap ring (230), slotted pockets (238), a snap ring recess (240), an upper seal bore (228), and a fishing seal bore (242). The lower splines (232) of the lower connection (208) are designed to mate with the upper splines (222) of the upper connection (206). The lower splines (232) are depicted as being located near the entrance of the upper end (234) of the lower connection (208); however, they can be located anywhere on the internal surface of the lower connection (208) as long as they are designed in a location that corresponds to the location of the upper splines (222) of the upper connection (206). As with the upper splines (222), the lower splines (232) are depicted in FIG. 2 as straight, vertical grooves, however, the lower splines (232) may be designed in an index path or similar profile. The lower splines (232) have the same purpose as the upper splines (222).

The internal surface of the lower connection (208) has a snap ring (230). The snap ring (230) is depicted in a relaxed state. When the upper connection (206) is inserted into the lower connection (208), the snap ring (230) is pushed open, into the snap ring recess (240), and then falls into the snap ring receptacle (224) of the upper connection (206) to form a connection between the upper connection (206) and the lower connection (208). The snap ring recess (240) is a groove machined into the internal surface of the lower connection (208). The snap ring recess (240) may have geometric features to prevent a non-symmetric snap ring (230) from being incorrectly installed. The geometric features of the snap ring recess (240) may allow the snap ring (230) to expand radially while preventing the snap ring from rotating. In further embodiments, the snap ring recess (240) may have features that allow the snap ring (230) to be radially expanded after the upper connection (206) has been inserted into the lower connection (208). This allows the connection between the upper connection (206) and the lower connection (208) to be disassembled manually. These features may be used to allow exerted radial pressure from rams within a blow-out preventer to expand the snap ring (230) to mechanically disconnect the upper connection (206) from the lower connection (208) while the quick connection assembly (204) is inside the well (116).

The lower connection (208) has upper seal bores (228) and fishing seal bores (242) machined into the internal surface. The upper seal bores (228) are designed to house the upper seals (226) and the fishing seal bores (242) are designed to house the fishing seal (244). The number and design of the upper seal bores (228) and the fishing seal bore (242) depend on the number and design of the upper seals (226) and fishing seal (244) respectively. The lower connection (208) has slotted pockets (238) machined into the internal surface. The slotted pockets (238) are designed to engage with keys (246) installed in keyways (248) machined into the fishing sub (210). The lower connection (208) is designed to fit over the fishing sub (210). Tension between the lower connection and fishing sub is directed through shear pins (250) used to connect the lower connection (208) to the fishing sub (210). Torque applied to the system is reacted against through the keys (246) and slotted pockets (238). In other embodiments, torque may be reacted against through splines, machined slots and pins, or any other designs known in the art.

The shear pins (250) are designed to shear when a pre-determined tension is applied to the system. The shearing of the shear pins (250) allows the lower connection (208) to disconnect from the fishing sub (210). The fishing sub (210) and the lower connection (208) may be assembled together prior to deployment to the field or downhole. The fishing sub (210) and the lower connection (208) may be machined together where the mating bore between the lower connection (208) and fishing sub (210) may be machined cylindrically and eccentric to the diameter of the fishing seal (244). This eccentricity prevents rotation; thus, keys, splines, or slots and pins are not needed to react to torque applied to the system. The lower connection (208) is depicted as a single homogeneous item to maximize strength; however, the lower connection (208) may be manufactured from a number of smaller components which may be connected together by any means known in the art such as being threaded, welded, bonded, swaged, or friction welded.

The fishing sub (210) of the quick connection assembly (204) has a central orifice with a fishing tool interface (252). The fishing tool interface (252) is an interface that a fishing tool may engage with. The fishing tool interface (252) is depicted as a standard GS fishing tool profile, but any standard fishing tool profile known in the art may be used. The fishing sub (210) has a first lateral end (254) and a second lateral end (256) the first lateral end (254) has the fishing tool interface (252) on the internal surface and at least one fishing seal (244) on the external surface. The fishing seal (244) are designed to mate with the fishing seal bore (242) of the lower connection (208). The fishing seal (244) are depicted as dual seals in FIG. 2; however, the fishing seal (244) may be a single seal or a plurality of additional seals. The fishing seal (244) are depicted as O-ring seals. In other embodiments, the fishing seal (244) may be quad-ring seals, spring-energized seals, or any sealing device known in the art. Further, the fishing seal (244) may not be identical, and the fishing seal (244) may be made of soft seals, hard seals, wiper seals, or any combination thereof.

The fishing tool interface (252) is also designed to mate with the conical nose (220) of the upper connection (206). The fishing sub (210) and the lower connection (208) may be installed together prior to the upper connection entering the lower connection (208). The length of the conical nose (220) of the upper connection (206) may be long enough such that the conical nose (220) enters the fishing sub (210), and a smooth thru-bore connection is created. Thus, fluid may pass through all three components using the internal orifice of the upper connection (206) and part of the second lateral end (256) of the fishing sub (210). The fishing tool interface (252) further acts to centralize the upper connection (206) during engagement, concentrically guiding the conical nose (220) and reducing the risk of the upper seals (226) or upper splines (222) contacting any protrusions as the connection is made. The external surface of the fishing sub (210) is machined with keyways (248) which hold keys (246). The keys (246) are designed to engage with the slotted pockets of the lower connection (208).

The second lateral end (256) of the fishing sub (210) has a means for connecting the fishing sub (210) to the lower section (202). The means for connecting may be any means known in the art such as welding, bolting, screwing, etc. In FIG. 2, the means for connecting the fishing sub (210) to the lower section (202) is a fishing sub bolted flange (258). The fishing sub bolted flange (258) is a bolted flange connection made of a combination of flanges, bolts, seals, and/or gaskets. The fishing sub bolted flange (258) is configured to mate with a corresponding bolted flange connection such as the lower section bolted flange (260). The fishing sub bolted flange (258) and the lower section bolted flange (260) may be screwed together using bolts. In other embodiments, the fishing sub bolted flange (258) and the lower section bolted flange (260) may be welded together.

The fishing sub (210) is depicted as a single homogeneous item to maximize strength; however, the fishing sub (210) may be manufactured from a number of smaller components which may be connected together by any means known in the art such as being threaded, welded, bonded, swaged, or friction welded. The fishing sub (210), the lower connection (208), and the lower section (202) may be manufactured together with the shear pins (250) acting as a means to disconnect the lower connection (208) from the fishing sub (210)/lower section (202). In other embodiments, the fishing sub (210) may be manufactured as a component of the lower section (202).

The lower section (202) is similar to that of the upper section (200). The lower section (202) and the upper section (200) are two components of the same string whether that be a production string, completions string, drill string, workover string, etc. The embodiment depicted in FIG. 2 shows the lower section (202) as production tubing (212) with a lower section bolted flange (260). The production tubing (212) may have production equipment fixed to it such as pumps (124), gas separators (122), valves, etc. However, the upper section (200) and the lower section (202) may be any downhole tool/equipment that may be deployed into a well (116), such as parts of an ESP string (112), without departing from the scope of this disclosure herein.

Figure 3:
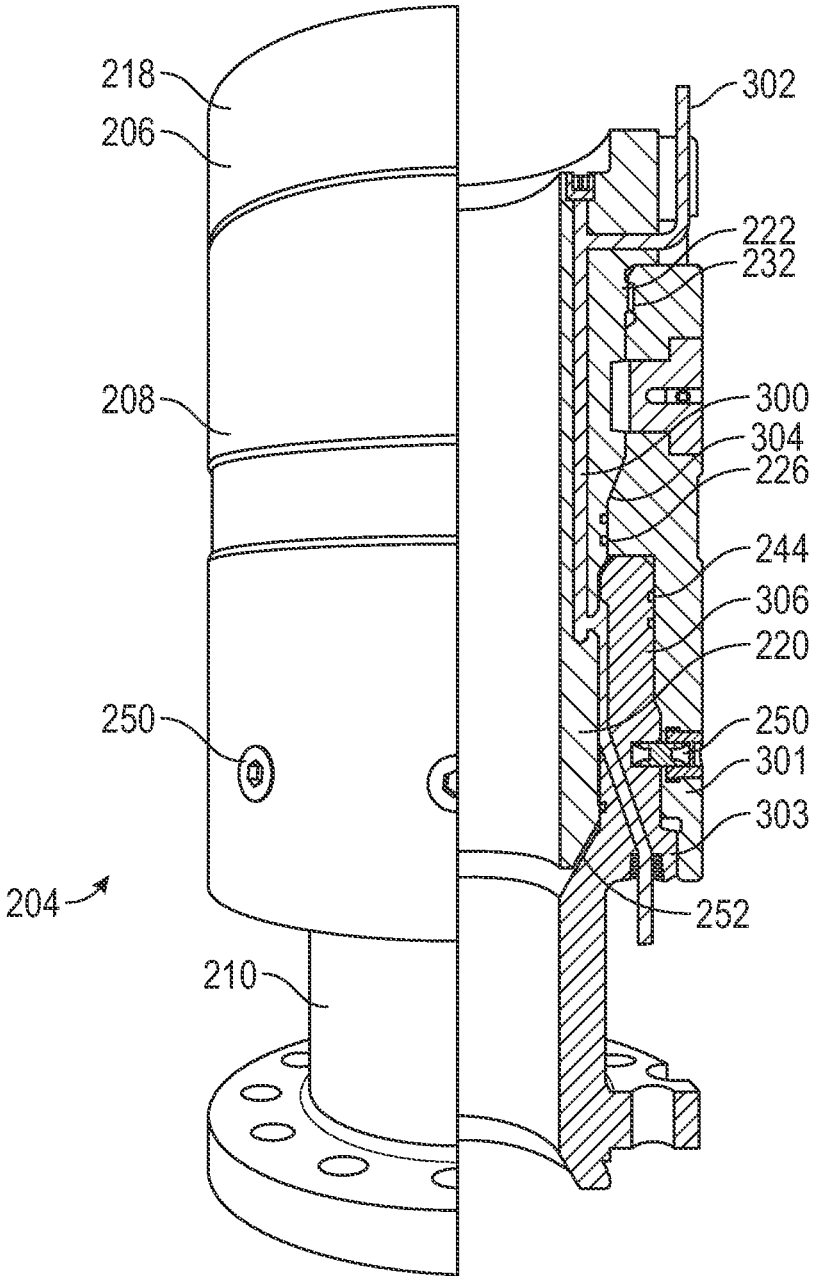
FIG. 3 shows a system in accordance with one or more embodiments.

FIG. 3 depicts the quick connection assembly (204) introduced in FIG. 2, fully assembled, with a pathway (300) for hydraulics or an electrical interface. Further, FIG. 3 depicts the quick connection assembly (204) having lower end splines (301) and fishing splines (303) in place of the keys (246)/keyways (248) and slotted pockets (238) depicted in FIG. 2. The components of the quick connection assembly (204) in FIG. 3 that are identical/similar to the components of the system described in FIG. 2 are not re-described for purposes of readability and have the same functions and components described above. Specifically, FIG. 3 shows how the upper connection (206), the lower connection (208), and the fishing sub (210) of the quick connection assembly (204) interconnect when fully assembled together. As shown, the lower connection (208) fits over the fishing sub (210), and the upper connection (206) passes through both the lower connection (208) and the fishing sub (210) to mate with the fishing tool interface (252).

The quick connection assembly (204) depicted in FIG. 3 shows the fishing sub (210) having fishing splines (303) and the lower connection (208) having lower end splines (301). The lower end splines (301) are located at the lower end (236) of the lower connection (208). The fishing splines (303) are located at the first lateral end (254) of the fishing sub (210). The lower end splines (301) are a plurality of manufactured grooves in the inner surface of the lower connection (208). The lower end splines (301) are designed to mate with the fishing splines (303). The fishing splines (303) are a plurality of manufactured grooves in the outer surface of the fishing sub (210). The lower end splines (301) and fishing splines (303) are similar to and have the same function as the upper splines (222) and lower splines (232); however, the fishing splines (303) and the lower end splines (301) react to torque between the fishing sub (210) and the lower connection (208) rather than between the upper connection (206) and lower connection (208). Further, the fishing splines (303) and the lower end splines (301) are a replacement of the keys (246)/keyways (248) and slotted pockets (238), previously described, and provide the same function.

Further, FIG. 3 shows how a hydraulic or electrical pathway (300) may exist through the quick connection assembly (204) when fully assembled. Certain downhole equipment, such as an ESP string (112), require electrical or hydraulic pathways (300) for communication, power transmission, and other operations. These pathways (300) may be made when the upper connection (206) is landed, and these pathways (300) may be broken when the upper connection (206) and the lower connection (208) are removed from the fishing sub (210). As disclosed previously, the upper connection (206) and the lower connection (208) have upper splines (222) and lower splines (232), respectively, that allow the upper connection (206) and lower connection (208) to engage without a singular radial alignment. Thus, the upper connection (206) and the lower connection (208) may engage in any of the spline position, and the pathways (300) may exist and allow for communication at any of the spline positions. The embodiment depicted in FIG. 3 shows the pathway (300) as a hydraulic connection. A hydraulic port (302) is located in the head (218) of the upper connection (206) through which hydraulic fluid may flow. The conical nose (220) of the upper connection (206) engages with the fishing sub (210), and the upper seals (226) seal a first annulus (304) between the upper connection (206) and the lower connection (208). The fishing seals (244) seal a second annulus (306) between the fishing sub (210) and the lower connection (208). The pathway (300) ensures hydraulic fluid can flow irrespective of the connected orientation at the splines. When the shear pins (250) shear, and the upper connection (206)/lower connection (208) assembly is disconnected from the fishing sub (210), the pathway (300) is disconnected without leaving debris behind. The pathway (300) may be an electrical connection with a slip ring or similar for an electrical contact to exist at any spline alignment. Multiple electrical or hydraulic pathways (300) may be achieved by spacing the pathways (300) along the length of the conical nose (220).

Figure 4:
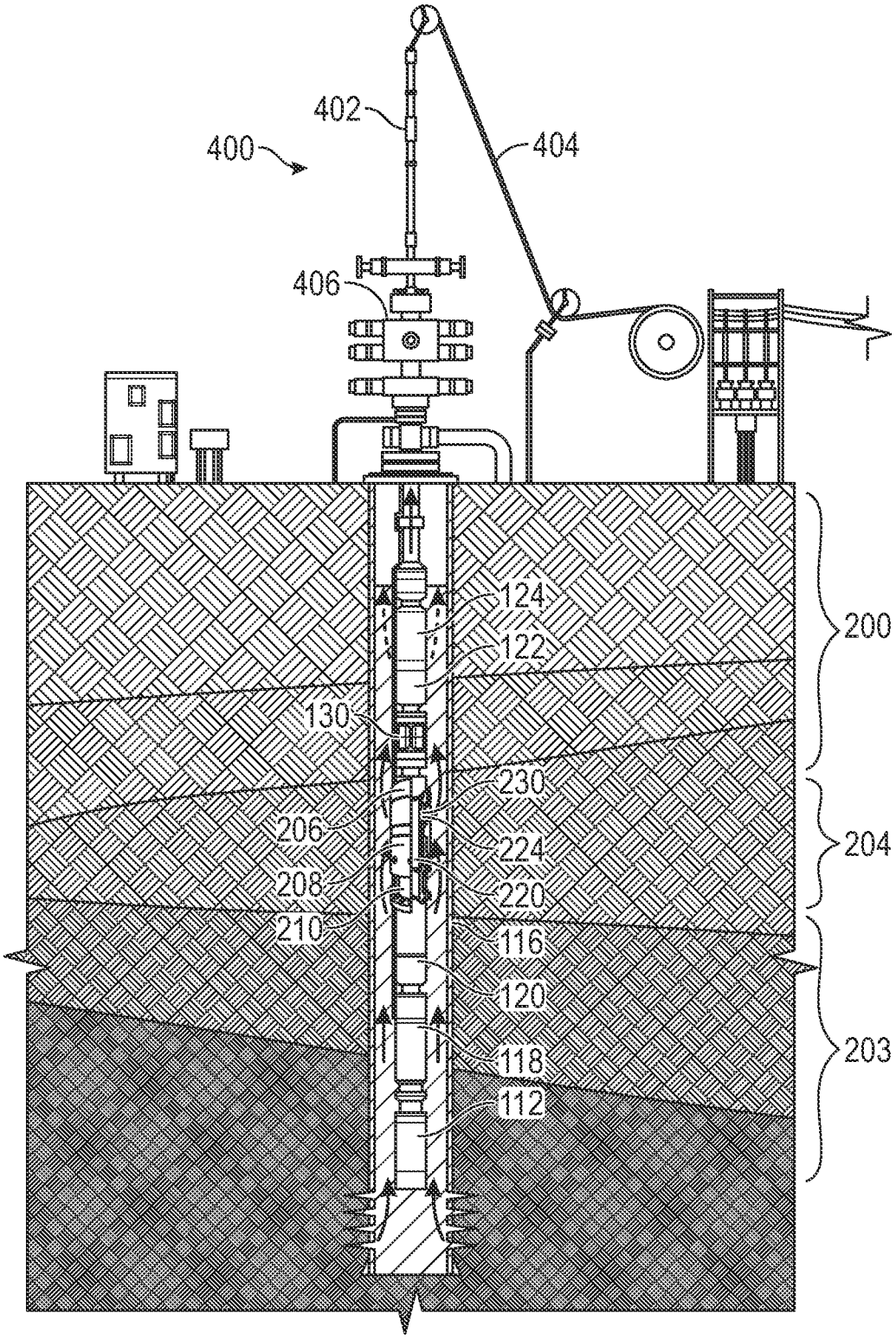
FIG. 4 shows a system in accordance with one or more embodiments.

FIG. 4 depicts a practical example of how the quick connection assembly (204) may be used. FIG. 4 depicts the ESP string (112), described in FIG. 1, installed in a well (116) using the quick connection assembly (204) depicted in FIGS. 2 and 3 and a lubricator system (400). The components depicted in FIGS. 1-3 that are identical/similar to the components of the system described in FIG. 4 are not re-described for purposes of readability and have the same functions and components described above. The lubricator system (400) is a system well known in the art. The ESP string (112) is split into two sections prior to being run in the well (116). The upper section (200) of the ESP string (112) has the pump (124), gas separator (122), and pump intake (130). The lower section (202) of the ESP string (112) has the motor (118) and motor protectors (120). The quick connection assembly (204) connects the upper section (200) to the lower section (202).

Prior to being run in the well (116), the fishing sub (210) and the lower connection (208) are connected together by the shear pins (250). The fishing sub (210) is connected to the lower section (202) by any means known in the art such as being threaded, welded, bonded, swaged, or friction welded. The upper section (200) is connected to the upper connection (206) by any suitable means such as being threaded, welded, bonded, swaged, or friction welded. The lower section (202)/fishing sub (210)/lower connection (208) is lowered into the lubricator (402) by the wireline (404). The lubricator (402) equalizes the pressure across the lower section (202)/fishing sub (210)/lower connection (208), and the wireline (404) lowers the lower section (202)/fishing sub (210)/lower connection (208) beneath the blow-out preventer (BOP) (406).

The lower section (202)/fishing sub (210)/lower connection (208) is hung beneath the lubricator (402) by one of the BOP's (406) rams and the wireline (404) releases. The upper section (200)/the upper connection (206) are lowered into the lubricator (402) for pressure to be equalized. The conical nose (220) of the upper connection (206) is inserted into the lower connection (208) until the snap ring (230) falls into the snap ring receptacle (224). The upper section (200) and the lower section (202) of the ESP string (112) are connected through the quick connection assembly (204), and the ESP string (112) may be lowered to a designated depth in the well (116). In other embodiments, a slickline may be used in place of the wireline (404) to lower the ESP string (112) in the well (116).

In further embodiments, the ESP string (112) may be broken up into more than two sections, and more than one quick connection assembly (204) may be used to connect the full ESP string (112) beneath the lubricator (402). In this scenario, the shear pins (250) of each quick connection assembly (204) may be designed to shear at different tensions such that the shear pins (250) in the upper most (closest to the surface) quick connection assembly (204) are designed to shear at a lower tension than each subsequent quick connection assembly (204) below. This may be done by changing the number of shear pins (250) in the quick connection assembly (204), varying the geometry and design of the shear pins (250), varying the material of the shear pins (250), or any combination thereof. While the embodiment depicted in FIG. 4 depicts an ESP string (112) using the quick connection assembly (204) to be assembled within the well (116), any downhole equipment that may be run into a well (116) using a lubricator (402) may use the quick connection assembly (204) without departing from the scope of this disclosure.

Using embodiments described above, the quick connection assembly allows the deployment of sections of an ESP (or any other downhole tool) through a wellhead lubricator before being assembled together into a larger ESP string below the lubricator. As a result, longer ESP assemblies may be deployed into a live well than would otherwise be possible. Such a modular method to deploy ESP sections removes the restrictions on ESP length and opens possibilities for more powerful ESPs to increase and maximize hydrocarbon recovery from the well without the risk of damaging the well or affecting productivity. Further, embodiments disclosed herein may be used as a retrofit to standard ESP components or may also be integrated into the components at design or manufacturing stage.

Figure 5:
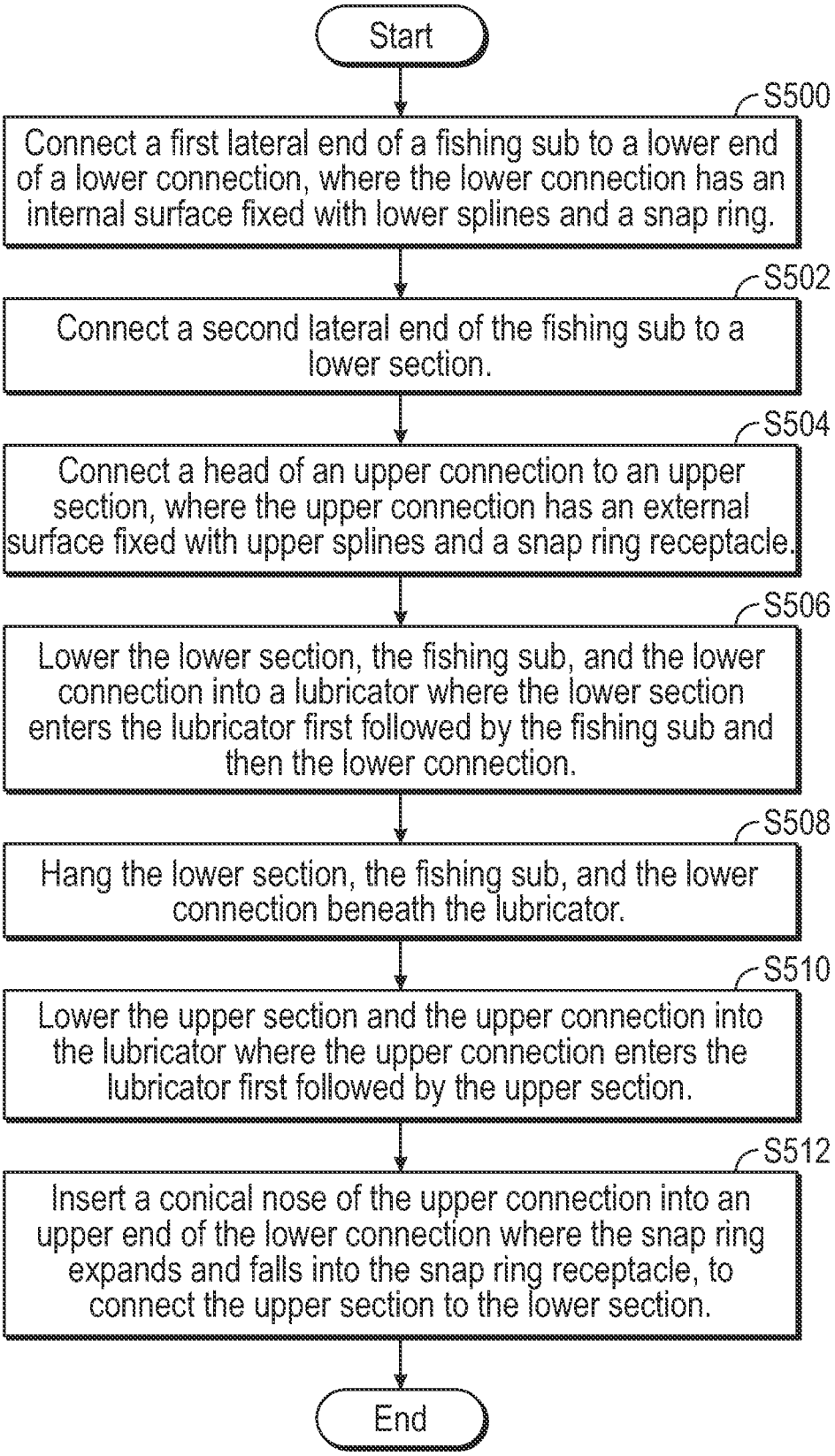
FIG. 5 shows a flowchart in accordance with one or more embodiments.

FIG. 5 depicts a flowchart in accordance with one or more embodiments. More specifically, FIG. 5 illustrates a method for using the quick connection assembly (204) to connect an upper section (200) of an ESP string (112) to a lower section (202) of the ESP string (112) beneath a lubricator (402). Further, one or more blocks in FIG. 5 may be performed by one or more components as described in FIGS. 1-4. While the various blocks in FIG. 5 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a first lateral end (254) of a fishing sub (210) is connected to a lower end (236) of a lower connection (208), where the lower connection (208) has an internal surface fixed with lower splines (232) and a snap ring (230) (S500). The fishing sub (210) is connected to the lower connection (208) by one or more shear pins (250) that are designed to shear when a predetermined tensile stress is reached. A second lateral end (256) of the fishing sub (210) is connected to a lower section (202) (S502) by any suitable means such as welding, bolting, screwing, etc. The lower section (202) may be a section of an ESP string (112). A head (218) of an upper connection (206), having an external surface fixed with upper splines (222) and a snap ring receptacle (224), is connected to an upper section (200) (S504) by any suitable means such as welding, bolting, screwing, etc. In one or more embodiments, the upper section (200) may be a section of an ESP string (112).

The lower section (202)/fishing sub (210)/lower connection (208) assembly is lowered into the lubricator (402) where the lower section (202) enters the lubricator (402) first followed by the fishing sub (210) and the lower connection (208) (S506). The lower section (202)/fishing sub (210)/lower connection (208) assembly may be lowered using wireline (404) or slickline. The lubricator (402) equalizes the pressure between the lower section (202)/fishing sub (210)/lower connection (208) assembly and the well (116). The lower section (202)/fishing sub (210)/lower connection (208) assembly is hanged beneath the lubricator (402) (S508) by rams of the BOP (406) or by lubricator (402) rams. The wireline (404) or slickline releases the lower section (202)/fishing sub (210)/lower connection (208) assembly.

The wireline (404) or slickline attaches to the upper section (200) and lowers the upper section (200)/upper connection (206) assembly into the lubricator (402) where the upper connection (206) enters the lubricator (402) first followed by the upper section (200) (S510). The lubricator (402) equalizes the pressure between the upper section (200)/upper connection (206) assembly, and the conical nose (220) of the upper connection (206) is inserted into an upper end (234) of the lower connection (208) where the snap ring (230) expands and falls into the snap ring receptacle (224) to connect the upper section (200) to the lower section (202) (S512).

This process may be repeated with as many quick connection assemblies (204) and ESP string (112) sections as needed. If more than one quick connection assembly (204) is used in one well (116), then the shear pins (250) of each quick connection assembly (204) may be designed to shear at different tensions such that the shear pins (250) in the upper most (closest to the surface) quick connection assembly (204) are designed to shear at a lower tension than each subsequent quick connection (204) below. This may be done by changing the number of shear pins (250) in the quick connection assembly (204), varying the geometry and design of the shear pins (250), varying the material of the shear pins (250), or any combination thereof.

Figure 6:
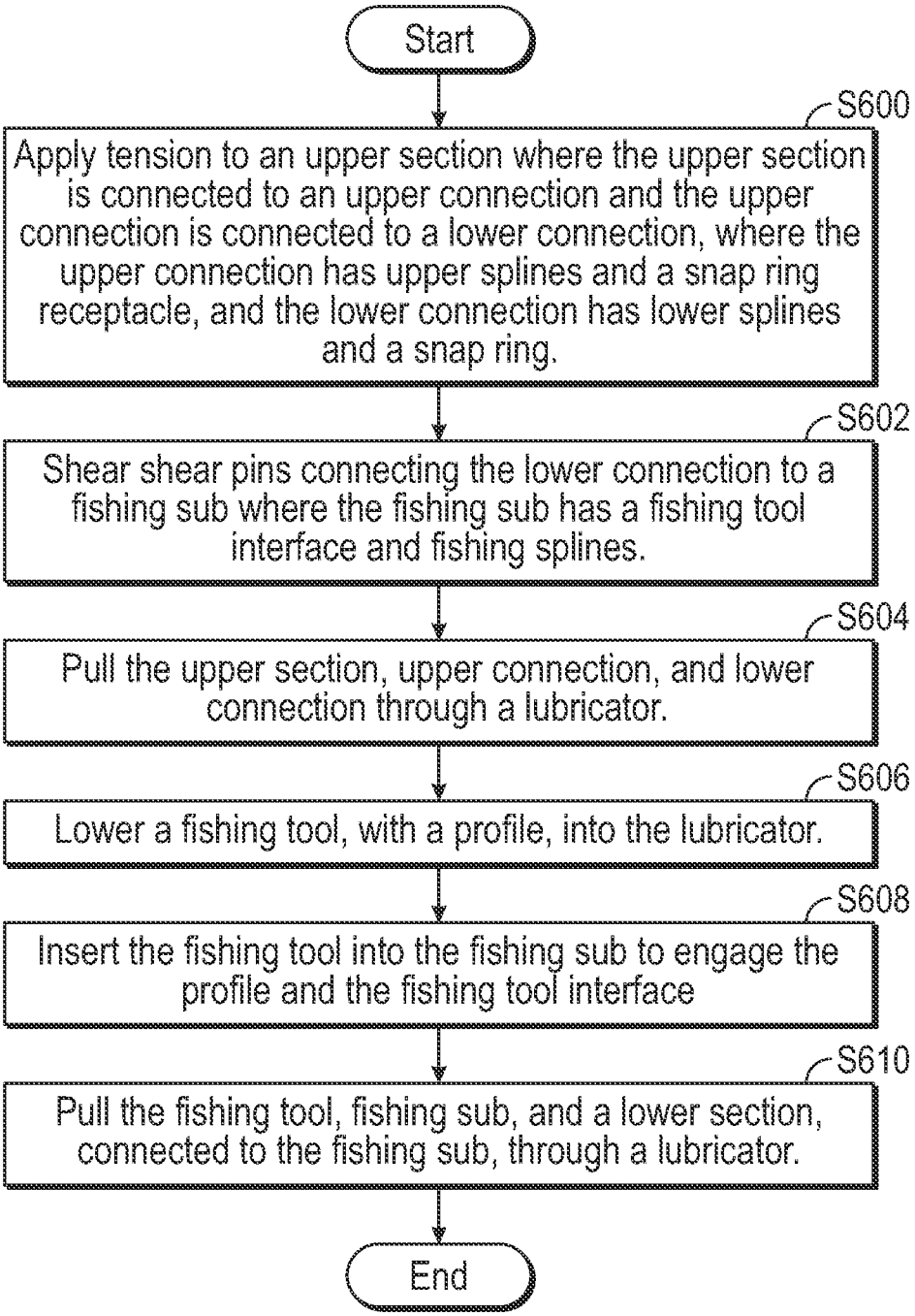
FIG. 6 shows a flowchart in accordance with one or more embodiments.

FIG. 6 depicts a flowchart in accordance with one or more embodiments. More specifically, FIG. 6 illustrates a method for using the quick connection assembly (204) to disconnect an upper section (200) of an ESP string (112) from a lower section (202) of the ESP string (112) beneath a lubricator (402). Further, one or more blocks in FIG. 6 may be performed by one or more components as described in FIGS. 1-4. While the various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, tension is applied to an upper section (200), where the upper section (200) is connected to an upper connection (206) and the upper connection (206) is connected to a lower connection (208) of the quick connection assembly (204). The upper connection (206) has upper splines (222) and a snap ring receptacle (224), and the lower connection (208) has lower splines (232) and a snap ring (230) (S600). As described above the upper section (200) may be a portion of an ESP string (112). The tension may be applied by a wireline (404) or slickline connected to the upper section (200). When the tension reaches a predetermined value, shear pins (250) that are connecting the lower connection (208) to a fishing sub (210), having a fishing tool interface (252) and keys (246), are sheared (S602).

The fishing sub (210) is connected to a lower section (202) that may be a section of an ESP string (112), and the upper section (200)/upper connection (206)/lower connection (208) assembly are disconnected from the fishing sub (210)/lower section (202) assembly. The upper section (200)/upper connection (206)/lower connection (208) assembly is pulled through a lubricator (402) (S604). The lubricator (402) equalizes the pressure between the upper section (200)/upper connection (206)/lower connection (208) assembly and the atmosphere, and the upper section (200)/upper connection (206)/lower connection (208) assembly may be removed from the lubricator (402). The upper connection (206) and lower connection (208) may be disassembled by inserting a tool (such as a hex key) into the upper connection (206) to expand the snap ring (230) allowing the lower connection (208) to be removed from the upper connection (206).

A fishing tool, with a profile, is lowered into the lubricator (402) (S606). The lubricator (402) equalizes pressure between the fishing tool and the well (116). The fishing tool is inserted into the fishing sub (210) to engage the profile and the fishing tool interface (252) (S608). The fishing tool, connected to the fishing sub (210)/lower section (202) assembly, is pulled through the lubricator (402) (S610). The lubricator (402) equalizes pressure between the fishing tool/fishing sub (210)/lower section (202) assembly and the atmosphere such that the fishing tool/fishing sub (210)/lower section (202) assembly may be removed from the lubricator (402).

This process may be repeated depending on how many quick connection assemblies (204) and ESP string (112) sections are in the well (116). If more than one quick connection assembly (204) is used in one well (116), then the shear pins (250) of each quick connection assembly (204) may be designed to shear at different tensions such that the shear pins (250) in the upper most (closest to the surface) quick connection assembly (204) are designed to shear at a lower tension than each subsequent quick connection assembly (204) below. This may be done by changing the number of shear pins (250) in the quick connection assembly (204), varying the geometry and design of the shear pins (250), varying the material of the shear pins (250), or any combination thereof.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A system for connecting an upper section to a lower section, the system comprising:

an upper connection having a ring shape with an external surface, wherein upper splines are formed on the external surface and the upper connection is fixed to the upper section;

a lower connection having a ring shape with an internal surface, wherein lower splines are formed on the internal surface and the lower splines are configured to mate with the upper splines of the upper connection; and a fishing sub having a first lateral end and a second lateral end, wherein the first lateral end is fixed to the lower connection by shear pins configured to shear when a pre-determined tension is applied to the system, and the second lateral end is fixed to the lower section, wherein the upper connection is inserted into the lower connection to form an engagement between the upper section and the lower section, and wherein the fishing sub comprises fishing splines formed on an external surface of the fishing sub.

2. The system of claim 1, wherein the upper connection comprises a snap ring receptacle.

3. The system of claim 2, wherein the lower connection comprises a snap ring.

4. The system of claim 3, wherein the snap ring receptacle is configured to receive the snap ring.

5. The system of claim 1, wherein the upper connection comprises at least one upper seal configured to seal a first annulus between the upper connection and the lower connection.

6. The system of claim 1, wherein the lower connection comprises lower end splines, formed on the internal surface of the lower connection, configured to mate with the fishing splines and react to torque applied to the system.

7. The system of claim 1, wherein the fishing sub comprises a fishing tool interface configured to engage with a fishing tool.

8. The system of claim 7, wherein the upper connection comprises a conical nose configured to engage with the fishing tool interface.

9. The system of claim 1, wherein the fishing sub comprises at least one fishing seal configured to seal a second annulus between the fishing sub and the lower connection.

10. A method for connecting an upper section to a lower section, the method comprising:

connecting a first lateral end of a fishing sub to a lower end of a lower connection, wherein the lower connection has an internal surface fixed with lower splines and a snap ring;

connecting a second lateral end of the fishing sub to a lower section;

connecting a head of an upper connection to an upper section, wherein the upper connection has an external surface fixed with upper splines and a snap ring receptacle;

lowering the lower section, the fishing sub, and the lower connection into a lubricator wherein the lower section enters the lubricator first followed by the fishing sub and then the lower connection;

hanging the lower section, the fishing sub, and the lower connection beneath the lubricator;

lowering the upper section and the upper connection into the lubricator wherein the upper connection enters the lubricator first followed by the upper section; and inserting a conical nose of the upper connection into an upper end of the lower connection wherein the snap ring expands and falls into the snap ring receptacle, connecting the upper section to the lower section, and engaging the upper splines and the lower splines to orient the upper connection and the lower connection.

11. The method of claim 10, further comprising:

sealing a first annulus between the upper connection and the lower connection using at least one upper seal fixed to the upper connection.

12. The method of claim 11, further comprising:

sealing a second annulus between the lower connection and the fishing sub using at least one fishing seal fixed to the fishing sub.

13. The method of claim 10, wherein the first lateral end of the fishing sub and the lower end of the lower connection are connected using shear pins designed to shear when a pre-determined tension is applied.

14. A method for disconnecting an upper section from a lower section, the method comprising:

applying tension to an upper section wherein the upper section is connected to an upper connection and the upper connection is connected to a lower connection, wherein the upper connection has upper splines and a snap ring receptacle, and the lower connection has lower splines and a snap ring;

shearing shear pins connecting the lower connection to a fishing sub wherein the fishing sub has a fishing tool interface and fishing splines;

pulling the upper section, upper connection, and lower connection through a lubricator;

lowering a fishing tool, with a profile, into the lubricator;

inserting the fishing tool into the fishing sub to engage the profile and the fishing tool interface; and pulling the fishing tool, fishing sub, and the lower section, connected to the fishing sub, through a lubricator.

15. The method of claim 14, further comprising:

inserting a tool into the upper connection to expand the snap ring allowing the lower connection to be removed from the upper connection.

16. The method of claim 14, wherein the upper splines engage with the lower splines to prevent applied torque from disconnecting the upper connection from the lower connection.

17. The method of claim 14, wherein the shear pins are sheared when a pre-determined tension is applied to the lower connection and the fishing sub.

18. The method of claim 14, wherein the fishing splines engage with lower end splines in the lower connection to prevent applied torque from disconnecting the lower connection from the fishing sub.

* * * * *